United States Patent [19]

Thien et al.

[11] 3,949,727

[45] Apr. 13, 1976

[54] CARBURETOR ENGINE WITH SOUND-PROOF ENCASING

[75] Inventors: Gerhard Thien; Heinz Fachbach, both of Graz, Austria

[73] Assignee: Hans List, Graz, Austria

[22] Filed: Sept. 19, 1974

[21] Appl. No.: 507,523

[30] Foreign Application Priority Data

May 20, 1974 Austria ..... 4183/74

[52] U.S. Cl. ..... 123/198 E; 123/41.7; 181/33 K

[51] Int. Cl.[2] ..... F02F 1/34; F02B 77/00

[58] Field of Search ..... 123/198 E, 195 C, 195 S, 123/41.7, 41.79; 181/33 K

[56] References Cited

UNITED STATES PATENTS

| | | | |
|---|---|---|---|
| 1,104,968 | 7/1914 | Crothers | 181/33 K |
| 1,890,794 | 12/1932 | Penning | 123/198 E |
| 1,922,200 | 8/1933 | Frank | 181/33 K |
| 2,011,988 | 8/1935 | Timian | 181/33 K |
| 3,521,726 | 7/1970 | Freyn | 181/33 K |
| 3,601,101 | 8/1971 | Thien et al. | 181/33 K X |
| 3,693,602 | 9/1972 | Thien et al. | 181/33 K X |
| 3,782,496 | 1/1974 | Thien et al. | 181/33 K |
| 3,791,482 | 2/1974 | Sykora | 181/33 K X |
| 3,796,280 | 3/1974 | Thien et al. | 181/33 K |

*Primary Examiner*—Charles J. Myhre
*Assistant Examiner*—Ira S. Lazarus
*Attorney, Agent, or Firm*—Watson, Cole, Grindle & Watson

[57] ABSTRACT

A sound-proofing encased carburetor internal combustion engine with a carburetor, a fuel tank and a fuel pipe located outside the encasing and a suction pipe extending through the encasing, sealed off at the point where it extends through the encasing, and connecting the carburetor with the internal combustion engine.

5 Claims, 2 Drawing Figures

CARBURETOR ENGINE WITH SOUND-PROOF ENCASING

Figure 1:
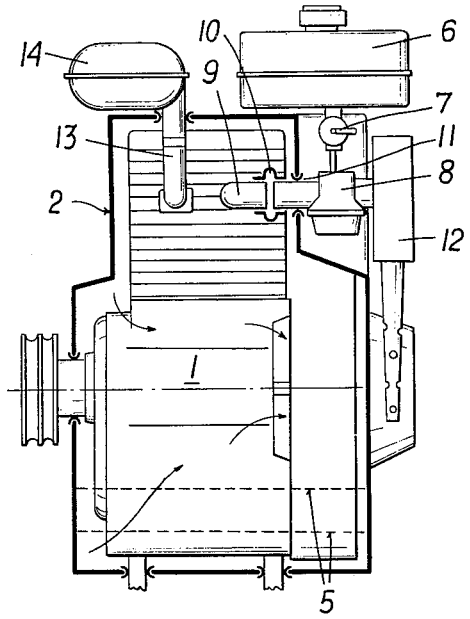

The present invention relates to a carburetor engine or a machine assembly operated by means of a carburetor engine with a sound-proof encasing extending completely thereabout.

For fuel-injection internal combustion engines various types of sound-proof encasings have already been devised which produced satisfactory results both with regard to their acoustical effect and their structural design. With Otto carburetor engines and their combinations with machines to be driven, the achievement of a sound-proof encasing extending completely thereabout is seriously complicated by the fact that in the event of leaks in the area of the fuel system, last not least owing to the difficulty of properly checking encased elements, fires are liable to develop since any gasoline vapors produced are easily inflammable which in contact with the hot members of the exhaust system or with parts of the ignition system. Theoretically, this risk could be avoided by separately encasing the fuel-carrying elements within the encasing, but in actual practice, the tight sealing of this space is hardly feasible particularly with small-sized engines, especially so since this sealing would have to be elastic in order to preclude any conduction of sound through solids from the engine to the encasing.

It is the object of the present invention to provide a carburetor engine or a machine assembly actuated by means of a carburetor engine with a sound-proof encasing extending completely thereabout, largely avoiding the usual risk of fire. According to the invention, the carburetor and the remaining fuel-carrying elements are arranged outside the encasing and the suction pipe leading from the carburetor to the engine is sealed off against the encasing in the place where it extends through said encasing. This solution of the problem hereabove mentioned not only provides a highly efficient protection against the risk of fires but it also distinguishes itself by its simplicity and space-saving arrangement.

Where the carburetor is connected in the usual manner to a flange of the suction pipe, the carburetor, connected to the engine through the suction pipe in a manner conducting sounds through solids, is liable to produce an albeit minor amount of noise, so that this arrangement is recommendable only for such engines as are not expected to be particularly sound-proof. In all other cases, according to a preferred embodiment of the invention, the suction pipe comprises two sections interconnected in a place located within the encasing by means of a sound-proofing element, for example, by a rubber sleeve. The acoustic efficiency of such an arrangement practically equals that achieved by an all-round encasing of the engine inclusive of the carburetor.

According to another embodiment of the invention the suction pipe extends through the encasing in a highly elastic sleeve. This makes the inevitable relative motions between the encasing and the engine, due to the elastic support of the encasing on the engine possible without impairing the sealing of the passage. In addition, the sealing sleeve prevents the projection of sound transmitted by air from the interior of the encasing.

Finally, it can prove advantageous according to another feature of the invention, in connection with an encasing ventilated by means of a blower and having at least one cooling-air inlet and one cooling-air outlet each, to provide the cooling-air inlet on the side of the encasing facing away from the carburetor. This prevents leaking fuel emerging from the carburetor, for example as a result of damaged sealing of the throttle shaft, from being drawn into the encasing by the blower together with the cooling air.

Figure 2:
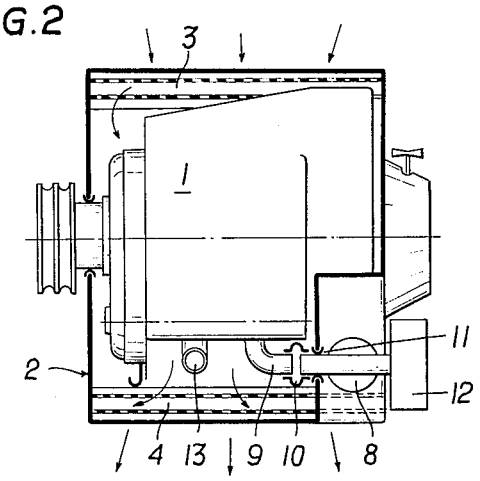

Further details of the invention will become apparent from the following description of an embodiment of the invention with reference to the accompanying drawing in which FIG. 1 shows a side elevation of an air-cooled single-cylinder Otto engine according to the invention with a sectional view of the encasing, and FIG. 2 is a top plan view of the engine shown in FIG. 1, with the encasing illustrated in the same manner.

The engine 1 is provided with a sound-proof encasing 2 extending completely thereabout, surrounding the outer surfaces of the engine in spaced relation thereto and forming at the same time cooling-air ducts for the blower air drawn-in by means of a blower through a cooling-air inlet 3 and evacuated through a cooling-air outlet 4. The upper and lower boundary lines of the cooling-air apertures are indicated by dotted lines 5 in FIG. 1. The encasing 2 is connected with the engine 1 in a manner known per se, but not illustrated in the drawing, elastically and in such a way as to absorb sound transmitted through solids.

The fuel tank 6 with the fuel tap cock 7 attached thereto and including a screen is supported on the outside of the encasing. The carburetor 8 located below is connected with the engine 1 by means of a suction pipe 9 comprising two sections interconnected within the encasing 2 by means of a sound-proof sleeve 10. The opening where the suction pipe 9 extends through the encasing 2 is sealed off by means of a highly elastic sleeve 11 permitting the compensation of the relative motions between the encasing 2 and the engine 1. The carburetor 8, the float chamber of which is fed in a manner known per se from the tank 6 through the fuel tap cock 7, carries the suction air filter 12 on the outside. The exhaust pipe 13 emerges from the encasing 2 by the shortest route and terminates in the exhaust muffler 14 located above.

It is the purpose of the arrangement illustrated in the drawing to strictly separate all fuel-carrying elements from the ventilated interior of the encasing so as to prevent fuel and/or fuel vapors from reaching hot portions of the walls of the engine where inflammation is liable to occur. The risk of fires is further reduced by the fact that the cooling-air is drawn in on the side of the encasing facing away from the carburetor 8 and the remaining fuel-carrying elements.

The invention is applicable to the same advantage also to assemblies with sound-proof encasings actuated by a carburetor engine, such as for instance a power-pump assembly or the like.

We claim:

1. In a sound-absorbing encased carburetor internal combustion engine having a crankcase, at least one cylinder and one cylinder head, in combination a sound-proof encasing extending completely thereabout and being spaced from the outer surfaces of said crankcase, cylinder and cylinder head of the engine, at least one aperture in the sound-proof encasing, a carburetor located outside the encasing adjoining said aperture, a suction pipe extending from the cylinder of the engine through said aperture as far as the carburetor and sealed off against the encasing in the area of said aperture, the suction pipe being sound insulated against the cylinder of the engine, further fuel-carrying structural elements being arranged outside said encasing and conductively connected to said carburetor.

2. In a sound-absorbing encased carburetor internal combustion engine according to claim 1, wherein said further fuel-carrying elements comprise a fuel tank arranged above said carburetor, a fuel pipe connecting the carburetor with said fuel tank, a fuel tap cock inserted in said fuel pipe.

3. In a sound-absorbing encased carburetor internal combustion engine according to claim 1, a suction pipe comprising two sections, one of the sections being connected with the cylinder of the engine and having an open extremity located within the encasing, the other section of the suction pipe being connected with the carburetor and having an open extremity opposite the open extremity of the first-mentioned section of the suction pipe, a sound-isolating flexible sleeve connecting the open extremities of the two sections of the suction pipe.

4. In a sound-proofing encased carburetor internal combustion engine according to claim 1, a highly elastic sealing sleeve inserted in said aperture of the encasing and encompassing said suction pipe in such a manner as to provide an airtight seal.

5. In a sound-proofing encased carburetor internal combustion engine according to claim 1, a cooling-air blower located inside the encasing, a cooling-air inlet and a cooling-air outlet provided in opposite sidewalls of the encasing, the carburetor being located in front of the sidewall having the cooling-air outlet.

* * * * *